US010051944B2

(12) United States Patent
McClellan et al.

(10) Patent No.: US 10,051,944 B2
(45) Date of Patent: Aug. 21, 2018

(54) COSMETIC POWDER REPAIRING DEVICE

(71) Applicants: Leslie McClellan, Tallahassee, FL (US); Melissa Oglesby, Tallahassee, FL (US)

(72) Inventors: Leslie McClellan, Tallahassee, FL (US); Melissa Oglesby, Tallahassee, FL (US)

( * ) Notice: Subject to any disclaimer, the term of this patent is extended or adjusted under 35 U.S.C. 154(b) by 261 days.

(21) Appl. No.: 14/802,238

(22) Filed: Jul. 17, 2015

(65) Prior Publication Data

US 2017/0015023 A1 Jan. 19, 2017

(51) Int. Cl.
*B29C 43/02* (2006.01)
*A45D 44/00* (2006.01)

(52) U.S. Cl.
CPC ..... *A45D 44/00* (2013.01)

(58) Field of Classification Search
CPC ..... A45D 44/00
USPC ..... 425/521, 110, 406, 318
See application file for complete search history.

(56) References Cited

U.S. PATENT DOCUMENTS 3,943,601 A * 3/1976 Kuhlman ..... A22C 7/00 100/218
5,102,677 A * 4/1992 Van Den Berghe ..... A21B 5/02 425/261
6,769,898 B1 * 8/2004 Voyatzakis ..... A21C 11/006 425/182
6,926,511 B1 * 8/2005 Schulze ..... B30B 11/08 425/345
7,353,831 B1 4/2008 Forsline
8,202,073 B1 * 6/2012 Kovalevich ..... A22C 7/0046 425/318
8,926,302 B1 * 1/2015 Buckley ..... A47J 43/00 425/318
9,149,046 B2 * 10/2015 McCarney ..... A21C 11/006
9,573,334 B2 * 2/2017 Nakai ..... B22F 3/15
2003/0031744 A1 * 2/2003 Cecil ..... B30B 11/08 425/107
2006/0078642 A1 * 4/2006 Palese ..... A22C 7/0046 425/416
2007/0031527 A1 * 2/2007 Koike ..... A23G 3/10 425/9
2008/0011320 A1 1/2008 Bouix
2012/0286441 A1 11/2012 Johnson
2013/0234351 A1 * 9/2013 Johnson ..... A61K 8/34 264/36.1
2016/0200024 A1 * 7/2016 Kim ..... B29C 47/0803 425/143
2017/0006996 A1 * 1/2017 Kim ..... A45D 33/008

* cited by examiner

*Primary Examiner* — Nahida Sultana
(74) *Attorney, Agent, or Firm* — J. Wiley Horton

(57) ABSTRACT

A method and device for use on pressed powders, such as those used in cosmetics. The inventive method uses a pressing device in order to repair broken and cracked pieces of powder. The repair device preferably includes a housing and a pressing mechanism. Preferably, repair device includes a magnet located on either the base of the housing or on a plate intended to receive a container. Preferably, repair device uses a screw and nut assembly for the pressing mechanism. The base includes a receiving plate connected to which rotates while the user is rotating the pressing mechanism. Preferably, pressing mechanism includes a few parts—a shaft or a screw, a handle, and a compressing plate. Preferably, the compressing plate is made to be removable from either the shaft or the screw.

18 Claims, 15 Drawing Sheets

COSMETIC POWDER REPAIRING DEVICE

CROSS-REFERENCES TO RELATED APPLICATIONS

Not Applicable.

STATEMENT REGARDING FEDERALLY SPONSORED RESEARCH OR DEVELOPMENT

Not applicable

MICROFICHE APPENDIX

Not Applicable

BACKGROUND OF THE INVENTION

1. Field of the Invention

This invention relates to the field of cosmetics. More specifically, the invention comprises a device for repairing dry or cracked cosmetic pressed powders.

2. Description of the Related Art

Cosmetic components available today are fabricated using many types of materials, solutions, and minerals. The method of application of the cosmetic depends on the consistency and/or formulation of the cosmetic. One of those most common consistencies/materials used for cosmetics is that of a pressed powder. A pressed powder formulation can be used for many different types of cosmetics such as concealer, foundation, and blush. Typically, a user applies a pressed powder using a brush or sponge applicator. The pressed powder cosmetic is smoothed over the user's skin, creating an even, natural look while covering blemishes and other imperfections. These formulations are both effective and expensive.

Oftentimes, a pressed powder is available in a compact or similar casing. A shallow, cylindrical container is filled with the pressed powder, then set into the outer casing. Typically, the outer casing is a hard, glossy plastic material. The cylindrical container which holds the pressed powder can also be plastic. However, the container is more typically constructed using a light-weight metallic material. Both the outer casing and the inner container come in different shapes and sizes. More often than not, these containers are circular. However, companies manufacture casings of any shape imaginable.

A typical make-up user carries a compact, or other casing containing a pressed powder, with them throughout most of the day. Thus, such a container is subjected to daily wear and tear, which includes dropping, tossing, slamming, and in general jostling within a bag. Over time, the press powder dries out a bit. As the dry powder is dropped or jostled, it has a tendency to crack and/or break up. The cases are typically circular. Thus, as a user applies the powder, the center diminishes more quickly than the outer regions, thereby causing the cosmetic powder to be in the thinned in the middle. This causes the powder to be more susceptible to cracking as well. Since, as discussed in the preceding text, these pressed powders are often relatively costly, cracked and broken pieces of pressed powder are undesirable.

The powder is most often held in the container by mechanical suction. The cracking forms segregated pieces that may actually fall out of the container. Therefore, what is needed is a device which can effectively repair the broken and cracked pieces of pressed powder in a cosmetic container. The present invention achieves this objective, as well as others that are explained in the following description.

BRIEF SUMMARY OF THE PRESENT INVENTION

The present invention comprises a device for use on pressed powders, such as those used in cosmetics. The present invention uses a pressing device in order to repair broken and cracked pieces of powder like those found in a cosmetic compact case. The repair device preferably includes a housing and a pressing mechanism. A preferred embodiment of the repair device includes a magnet located on either the base of the housing or on a plate intended to receive a container from a cosmetic case. This allows the container to remain in place while the powder is being pressed.

A preferred embodiment of repair device uses a screw and nut assembly for the pressing mechanism. For this embodiment the base includes a receiving plate connected to a thrust bearing in order to maintain pure compression while the user is rotating the pressing mechanism in order to compress the powder.

In a preferred embodiment of the repair device, the pressing mechanism includes several parts—such as a shaft, a screw, a handle, and a compressing plate. Preferably, the compressing plate is made to be removable from either the shaft or the screw. This allows the user to remove the compressing plate, which is the part in direct contact with the powder, in order to clean the plate. Of course, with the different embodiments, the handle may change slightly in order to conform to each embodiment.

REFERENCE NUMERALS IN THE DRAWINGS

Figure 1:
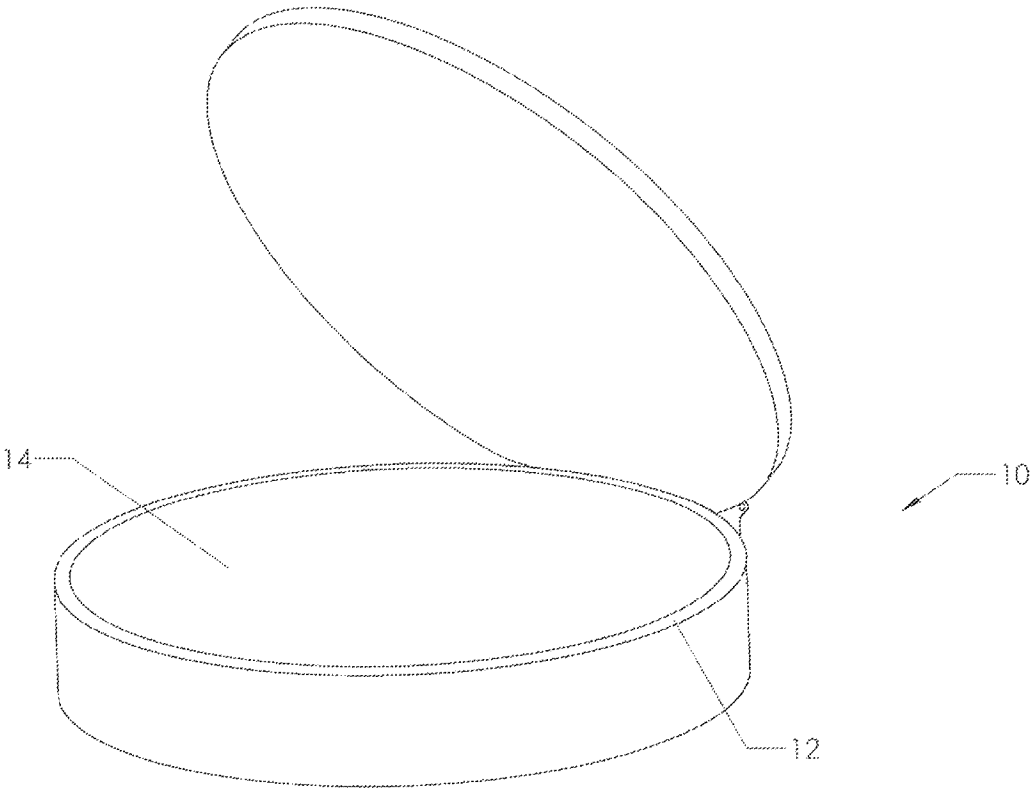
FIG. 1 (PRIOR ART)
FIG. 1 is a perspective view, showing a prior art cosmetic compact case.

10 compact cosmetic case
12 cosmetic container
14 cosmetic powder
16 powder crack
18 powder piece
20 cosmetic repair device
22 housing
24 pressing mechanism
25 shaft
26 pressing screw
28 pressing handle
30 compressing plats
32 support
34 base
36 top portion
38 magnet
40 opening
42 threaded boss
44 threaded hole
46 receiving plate
48 thrust bearing
50 outer bearing casing
51 inner hearing easing
52 ball
54 ball retainer
56 pivot point
58 bearing recess
60 piston
62 piston linkage
64 cylindrical boss
66 central hole
68 pivot point
70 vertical mount
72 pivot point
74 separation tool
76 projection
78 translating nut
80 release switch
82 lever

DETAILED DESCRIPTION OF THE INVENTION

The present invention provides a method and device for repairing cracked and/or broken pieces of pressed powder such as those found in a cosmetic case for foundation, blush, or concealer. FIG. 1 shows a prior art compact cosmetic case 10. Cosmetic container 12 is typically affixed within compact cosmetic case 10 using adhesive or some other known method. Cosmetic container 12 is filled with cosmetic powder 14. The reader will note that cosmetic powder 14 is not cracked or broken in the figure. However, as the user uses cosmetic powder 14, there becomes less powder and it dries out, thereby increasing the susceptibility of the powder 14 to cracking and breaking.

Figure 2:
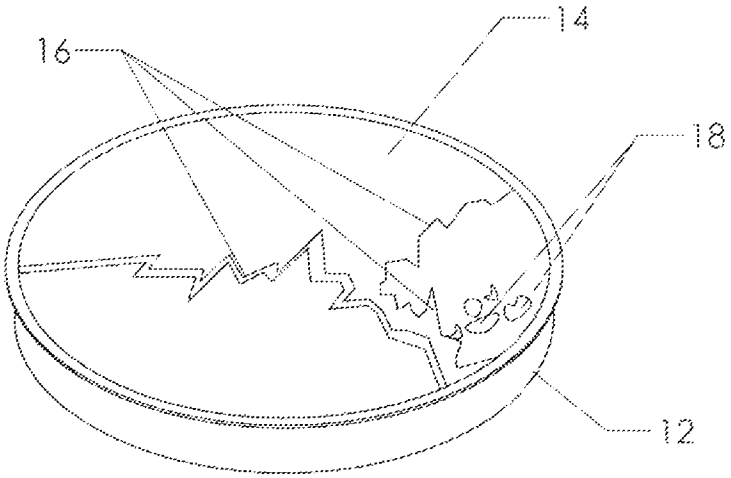
FIG. 2 (PRIOR ART)
FIG. 2 is a perspective view, showing a prior art cosmetic container with small pieces of powder and cracked powder.

FIG. 2 shows a cosmetic container 12 removed from compact cosmetic case 10 (not shown in FIG. 2). As illustrated, cosmetic powder 14 is broken up into pieces. This is evident by powder cracks 16 and powder pieces 18. In general, when cosmetic powder 14 is in the state shown in FIG. 2, it is more difficult for the user to apply powder 14. In addition, when the user opens compact case 10, the powder pieces 18 may be ejected from container 12, thereby causing those powder pieces 18 to be lost. While it may seem trivial to lose some broken up pieces of pressed powder from a compact case, the cost of cosmetic products can be high. Thus, a device which aids in increasing the lifetime of one of these products is very valuable.

Figure 3:
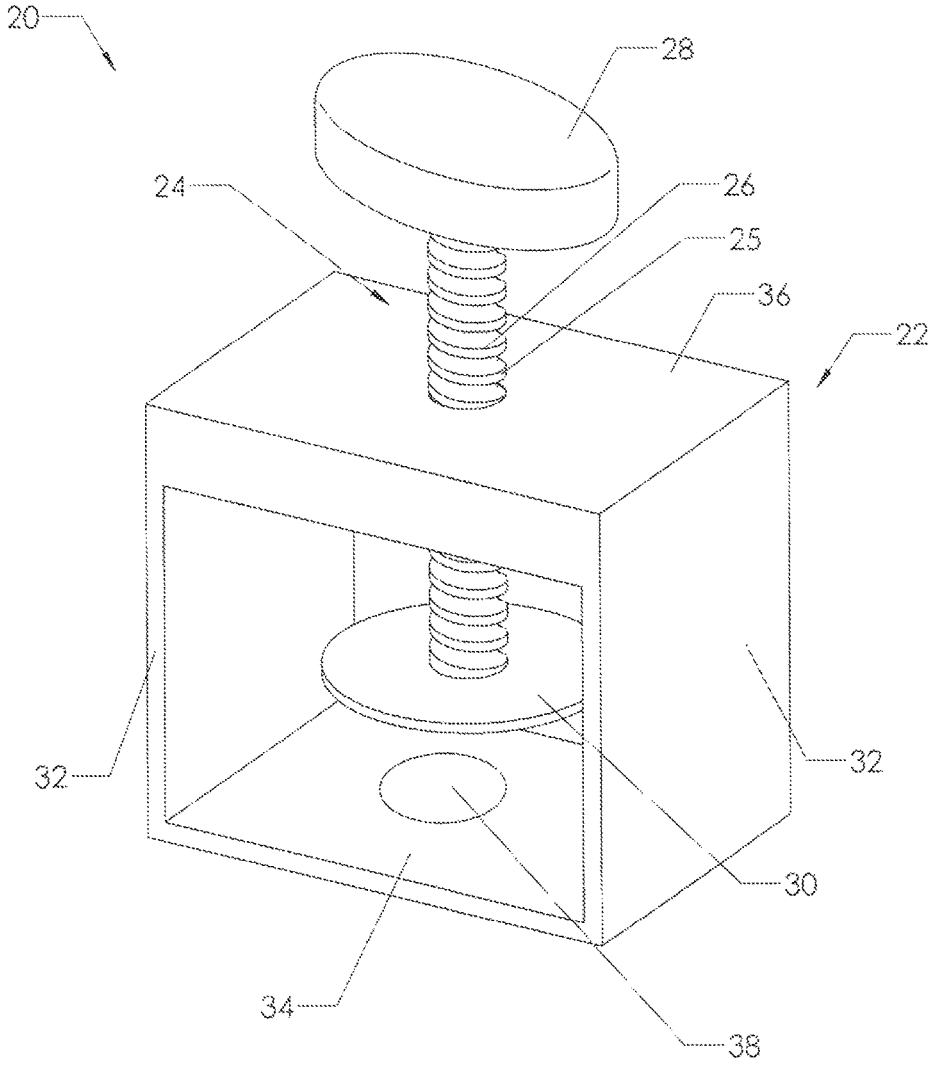
FIG. 3 is a perspective view, showing an embodiment of cosmetic repair device.

FIG. 3 shows a preferred embodiment the cosmetic repair device 20 of the present invention. This embodiment of the repair device 20 includes housing 22 and pressing mechanism 24. Preferably, pressing mechanism 24 includes shaft 25, pressing handle 28, and compressing plate 30. Housing 22 preferably includes at least two supports 32, a base 34, and a top portion 36. In a preferred embodiment of the present invention, base 34 includes magnet 38. In addition, top portion 36 is preferably capable of receiving pressing mechanism 24. In a preferred embodiment of pressing mechanism 24, thread is included in order to create pressing screw 26.

Figure 4:
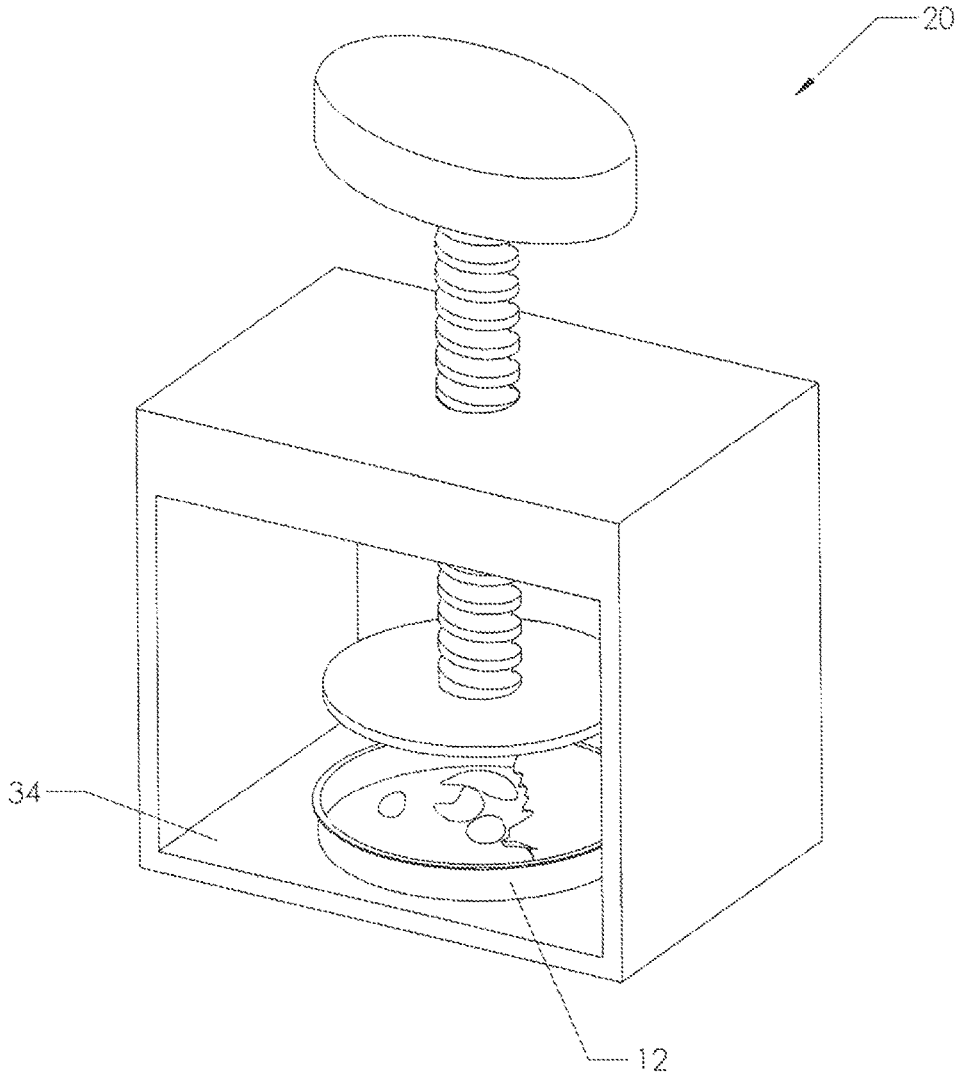
FIG. 4 is a perspective view, showing the embodiment of repair device of FIG. 3 with a container inserted.

FIG. 4 shows cosmetic repair device 20 with cosmetic container 12 resting upon base 34. Preferably, container 12 is temporarily affixed to magnet 38 (not visible in FIG. 4). This allows the user to use repair device 20 while container 12 remains in place. A simpler version of repair device 20 does not include a magnet, but allows container 12 to simply rest on base 34. Of course, if container 12 is fabricated from a plastic material, magnet 38 is not helpful in maintaining the position of container 12 and a different retention mechanism may be used.

In some embodiments, supports 32 may be posts or columns positioned at each corner between base 34 and top portion 36. This would allow access from all sides of repair device 20. In addition, base 34 includes a recess in some embodiments. This recess is positioned and dimensioned in order fit a commonly sized container 12. Supports 32 and top portion 36 may also be combined into a single structure such as an arch.

Figure 5A:
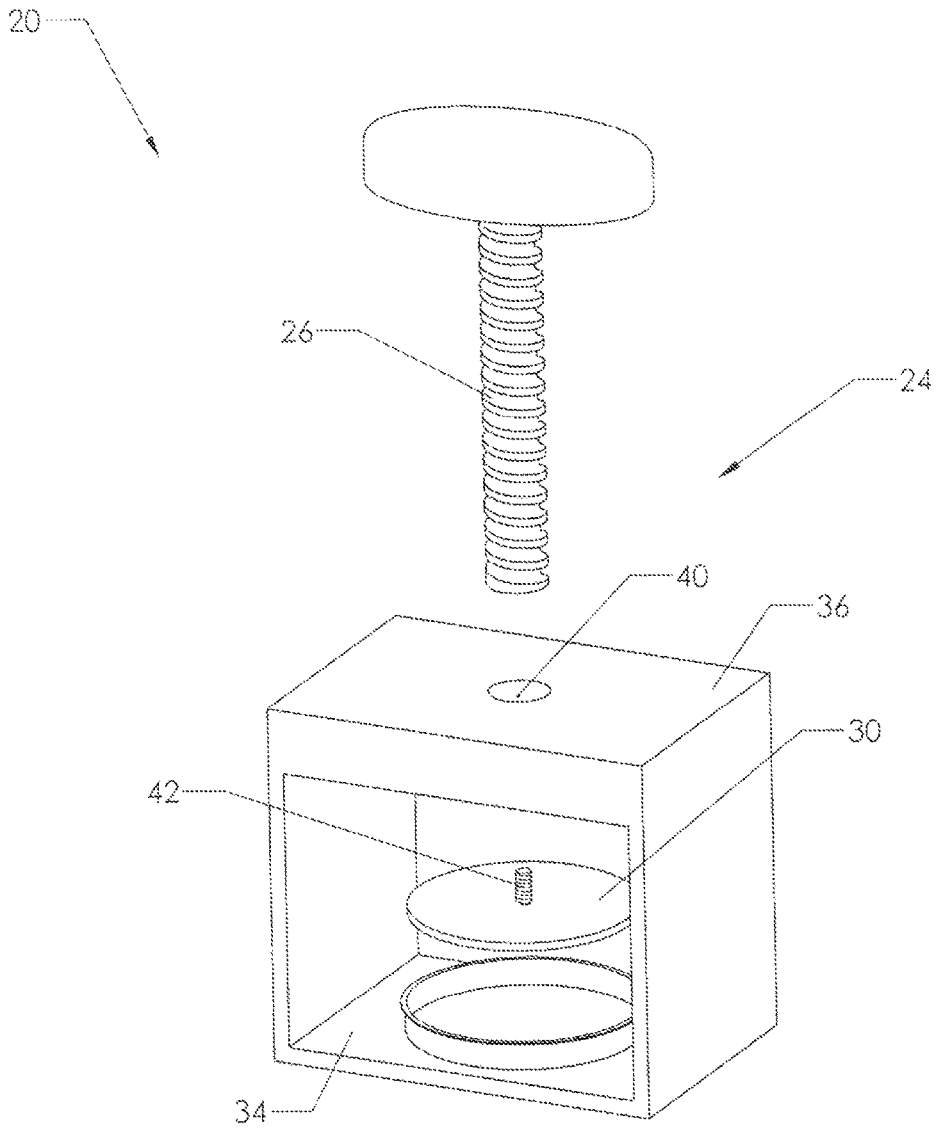
FIG. 5A is an exploded view, showing the embodiment of repair device shown in FIG. 3.
Figure 5B:
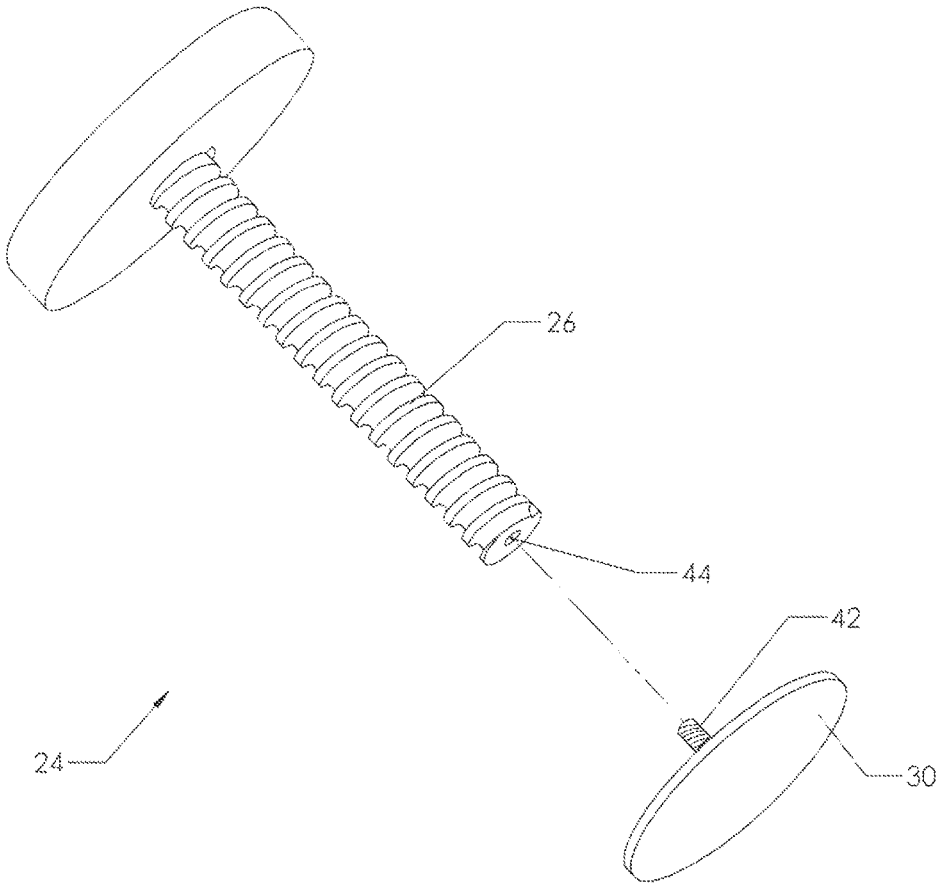
FIG. 5B is an exploded view, showing the connection between the pressing screw and the compressing plate.

FIG. 5A shows an exploded view of repair device 20. As illustrated, top portion 36 includes opening 40. Preferably, pressing screw 26 fits into opening 40. In one embodiment of the inventive device, pressing screw 26 has male threads while opening 40 has female threads. Thus, when pressing screw 26 is rotated, pressing device 24 translates towards or away from base 34. FIG. 5B shows an exploded view of pressing mechanism 24. In a preferred embodiment of the present invention, compressing plate 30 is made detachable from pressing screw 26. This allows the user to remove compressing plate 30 in order to clean compressing plate 30 or to replace compressing plate 30 with a different sized plate. Different cosmetic containers come in different sizes so different sizes of plate 30 may be required. In one such embodiment, pressing screw 26 preferably includes a threaded hole 44 on the underside of pressing screw 26. Compressing plate 30 preferably includes threaded boss 42 which fits into threaded hole 44. Of course, this is one method of detaching/reattaching compressing plate 30 from pressing screw 26—there are many other methods which could be employed in order to remove and attach compressing plate 30. For example compressing plate 30 can be attached to pressing screw 26 using a press snap fitting, a pipe clamp fitting, or any other known method in the art.

Those familiar with the art will realize that the embodiment of the present invention illustrated in FIG. 5 does not allow for pure compression. As the user rotates pressing handle 28 in order to translate compressing plate 30 downward into container 12, compressing plate 30 is also rotating. Thus, as cosmetic powder 14 is pressed, its surface may also be twisted within container 12. Therefore, with this embodiment of the present invention pure compression is not possible.

Figure 6:
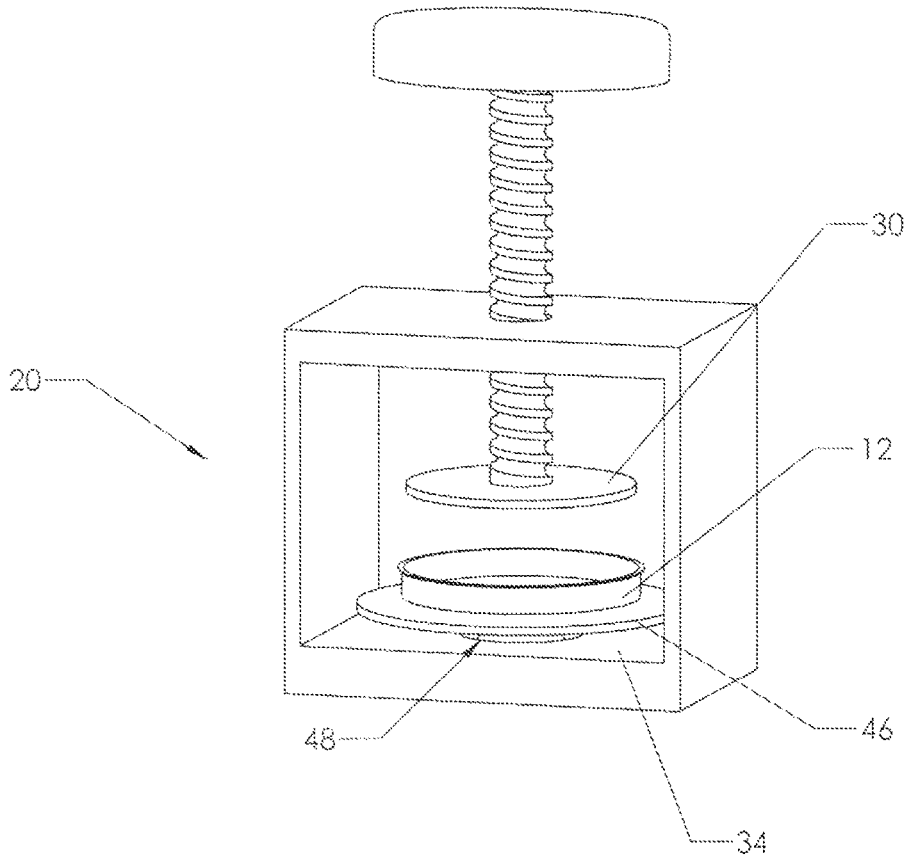
FIG. 6 is a perspective view, showing another embodiment of the repair device of the present inventive method which includes a thrust bearing.
Figure 7A:
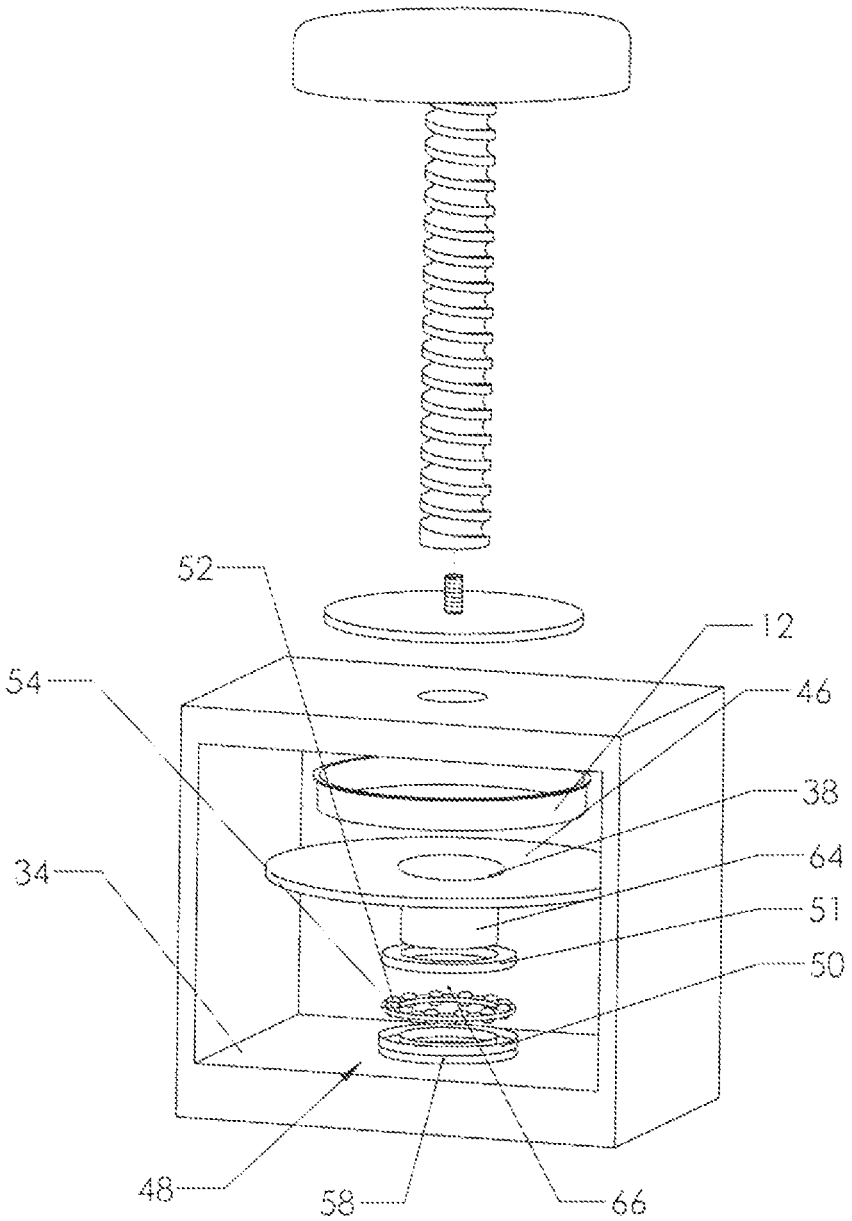
FIG. 7A is an exploded view, showing the embodiment of repair device shown in FIG. 6.

As those familiar with the art will realize, there are a few techniques which can be incorporated in order to create pure compression between compressing plate 30 and container 12. One such technique is shown in FIG. 6. In this embodiment of the present invention, cosmetic repair device 20 includes thrust bearing 48. Thrust bearing 48 is preferably fixed to base 34. FIG. 7A shows an exploded view of the embodiment shown in FIG. 6. Thrust bearing 48 can be affixed to base 34 in a number of ways. One method of attaching thrust bearing 48 to base 34 is by press fitting bearing 48 into bearing recess 58. Preferably, thrust bearing 48 includes outer bearing casing 50, inner bearing casing 51, balls 52, and ball retainer 54. As those familiar with the art will know, outer bearing casing 50 is press fit into bearing recess 58, thereby allowing inner bearing casing 51 to rotate freely as a typical ball bearing assembly rotates. In a preferred embodiment of cosmetic repair device 20, receiving plate 46 includes cylindrical boss 64. Preferably, cylindrical boss 64 fits into central hole 66 of thrust bearing 48. This engagement allows receiving plate 46 to rotate without contact with base 34. Thus, as the user rotates pressing screw 26 container 12 is able to rotate allowing for pure compression of powder 14 since makeup container 12 rotates with pressing screw 26. Of course, there are multiple methods of attaching receiving plate 46 to thrust bearing 48—this is simply one such method.

As illustrated, receiving plate 46 preferably includes magnet 38. Typically, prior art container 12 is metal, thereby allowing magnet 38 to keep container 12 affixed to receiving plate 46. In some embodiments of the present invention, receiving plate 46 includes a lip in order to retain container 12 in the event container 12 is not metal. Also, thrust bearing can be any known thrust bearing in the art. It is not required to be a ball bearing. For example thrust bearing 48 can be a fluid thrust bearing, a roller, double-roller, or any other relevant bearing known in the art. Even a nylon brush would work in the present invention. Those familiar with the art will note that the force exerted upon thrust bearing 48 due to pressing mechanism is minimal.

Those familiar with the art will realize that there are many techniques which can be used to mount receiving plate 46 to thrust bearing 48. The method illustrated is a simple method commonly used in axle, bearing, and wheel assemblies. However, in another embodiment, cylindrical boss 64 has a larger diameter which is attached directly to inner bearing casing 51—similar to "Lazy Susan" type rotating plate for spices. In addition, bearing 48 could be mounted directly to base 34 without the presence of bearing recess 58.

Figure 7B:
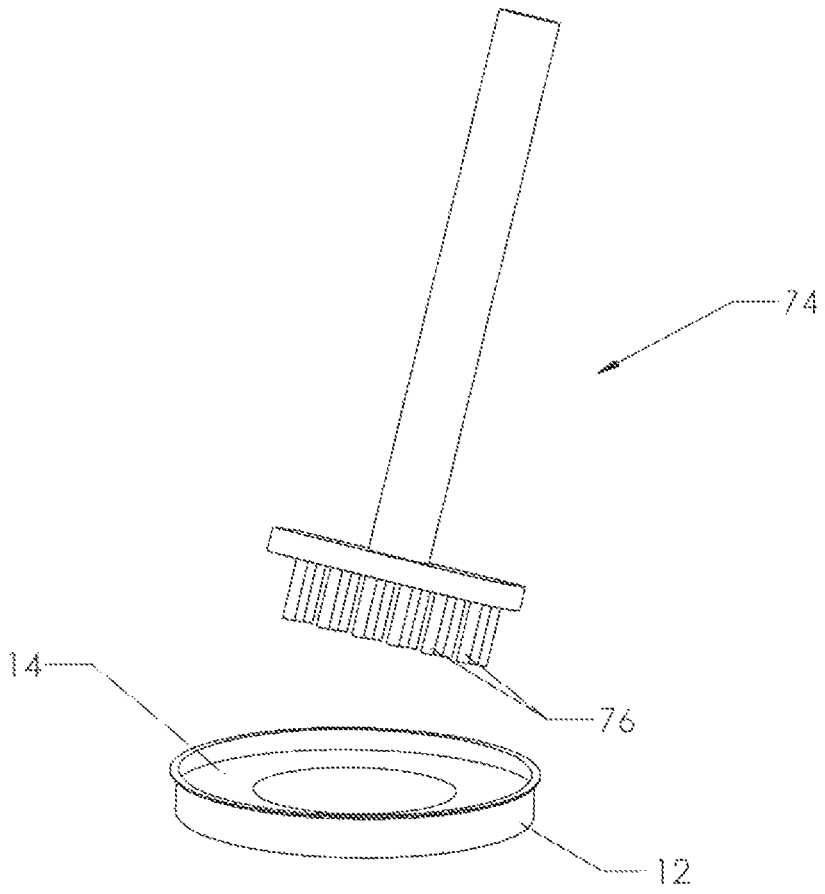
FIG. 7B is a perspective view, showing the separation tool used to break up the pressed powder.

In some instances, it is necessary to further break powder 14 down prior to pressing powder 14 using repair device 20. Similar to the example stated in the preceding text where powder 14 is in a torus shape due to the user scooping powder only from the center. If the user desires to reform the powder 14, he or she can break up powder 14 prior to pressing it. This torus shape of powder 14 is shown in FIG. 7B. Those familiar with the art will realize that this is a common occurrence with cosmetic compact cases. Preferably, separation tool 74 includes projections 76. The user grasps separation tool 74 and inserts tool 74 into container 12 with projections 76 striking the powder 14, as illustrated. As the user repeatedly inserts separation tool 74, powder 14 is broken up into pieces within container 12. Once this is complete, container 12 can be inserted into repair device 20.

Figure 8:
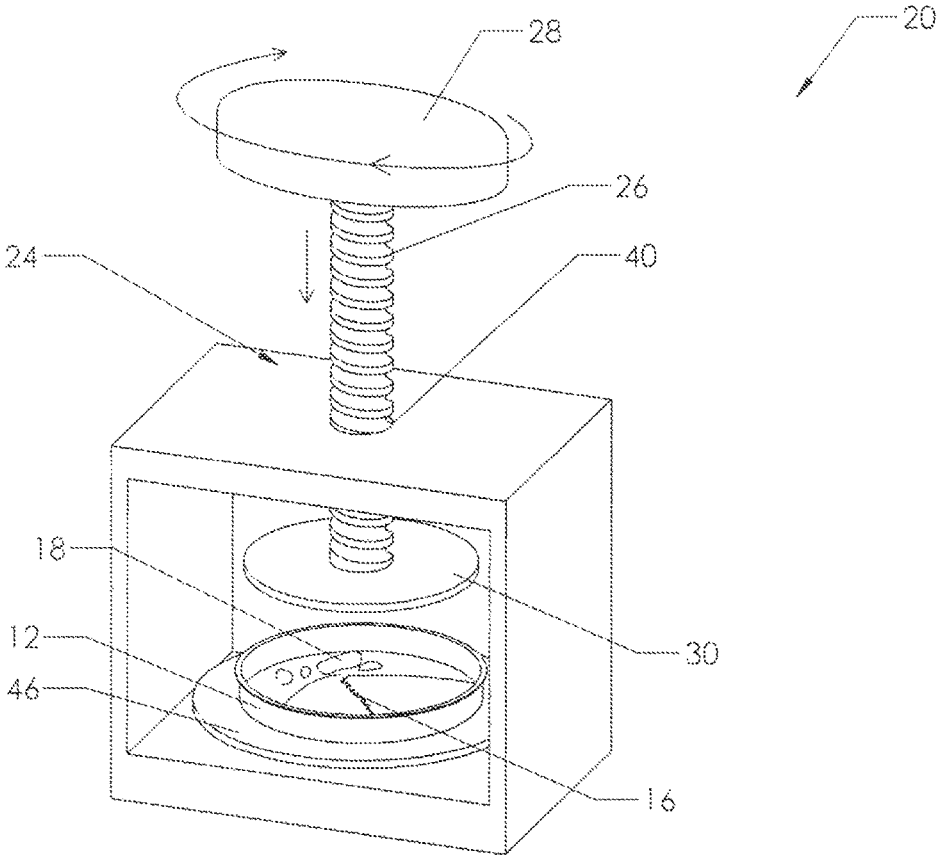
FIG. 8 is a perspective view, showing the embodiment of repair device shown in FIG. 6 as the user begins to rotate the handle of the pressing mechanism.
Figure 9:
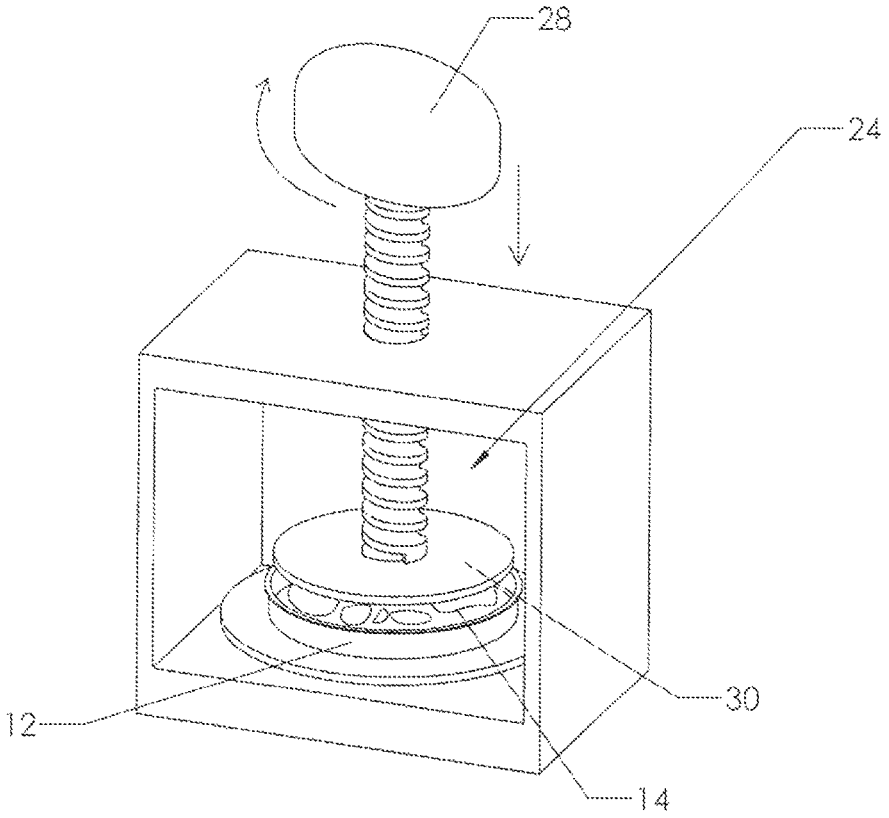
FIG. 9 is a perspective view, showing the embodiment of repair device shown in FIG. 6 as the user continues to rotate the handle of the pressing mechanism.

FIGS. 8-10 show the steps of repairing powder cracks 16 and powder pieces 18 into a fully formed pressed powder 14 using cosmetic repair device 20. The user first removes container 12 from compact case 10 or any other cosmetic case for the pressed powder he or she wishes to repair. Then, the user places container 12 on receiving plate 46. The container 12 remains attached to receiving plate 46 due to magnet 38 (not visible in this view). FIG. 8 shows repair device 20 in a state where the user has just loaded container 12 onto receiving plate 46. Once container 12 is loaded, the user begins the process of compressing powder pieces 18. As user rotates pressing handle 28 clockwise, as shown by the arrows pressing mechanism 24 translates downward (toward container 12 in the view in FIG. 8). Preferably, top portion 36 includes a female thread which acts as a stationary nut. Thus, when the user turns pressing screw 26, the threads on pressing screw 26 force pressing screw, and therefore compressing plate 30 downward.

FIG. 9 shows pressing mechanism 24 in a state where compressing plate 30 is preferably centrally aligned with container 12. In this view, compressing plate 30 is at an instant just before plate 30 contacts pressed powder 14. In the event that container 12 and compressing plate 30 are not concentric at this point, the user should align compressing plate 30 and container 12 in order to compress powder 14.

Figure 10A:
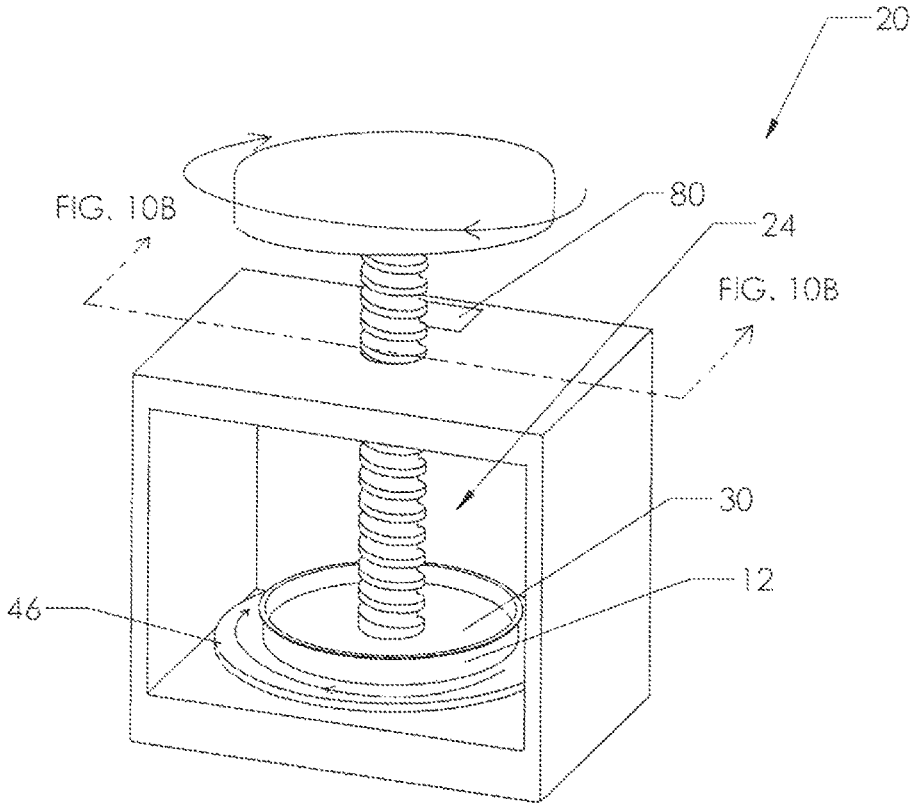
FIG. 10A is a perspective view, showing the embodiment of repair device shown in FIG. 6 where the compressing plate is pressed against the cosmetic powder.

FIG. 10A shows cosmetic repair device 20 in a "closed slate." Compressing plate 30 is pressing down on pressed powder 14 within container 12. As indicated by the arrows, as the user rotates pressing mechanism 24 receiving plate 46 also rotates. This is due to thrust bearing 48 (not visible in FIG. 10A). The rotation of receiving plate 46 as pressing mechanism 24 is rotated allows compressing plate 30 to compress powder 14 without also twisting powder 14. This is advantageous as it prevents powder 14 from escaping container 12 and becoming too thin in some regions.

Once the user is finished compressing cosmetic powder 14, the user can rotate handle 28 counter clockwise in order to translate pressing mechanism 24 upwards (away from container 12). As shown in FIG. 5B, compressing plate 30 is preferably removable from pressing screw 26. This allows the user to remove and easily wash compressing plate 30 after use in the event that some powder 14 remains on compressing plate 30.

Figure 10B:
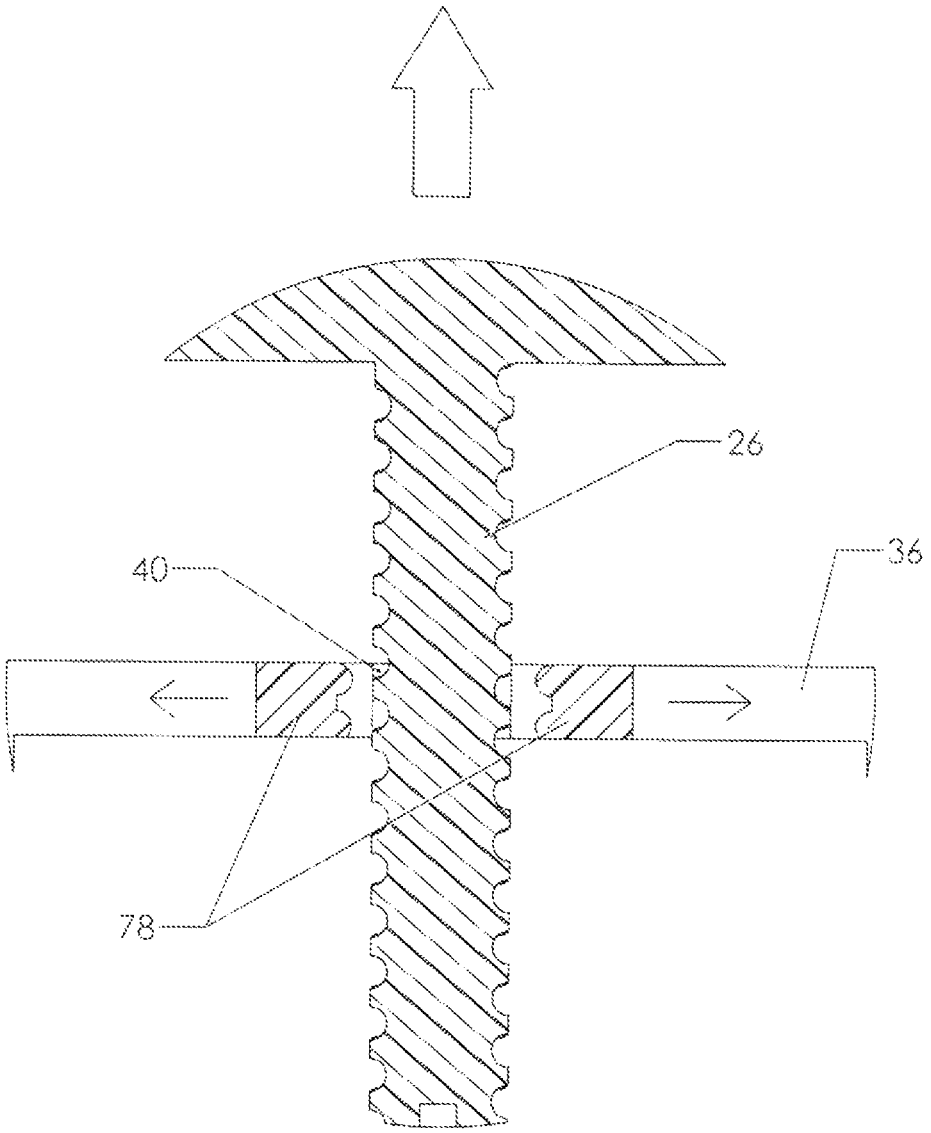
FIG. 10B is a sectional view, showing the quick release mechanism of the pressing screw.

In some instances of the embodiment, shown in FIG. 10A, a quick-release feature is included. This quick release feature allows the user to quickly traverse pressing screw 26 upward after the user has completed repairing powder 14 without "unscrewing" pressing screw 26. FIG. 10B shows one such feature. The reader will note that during the pressing stage of repairing cosmetic powder (FIGS. 8-10A), the threads of pressing screw 26 are engaged with the threads of translating nut 78. This is a well known technique of linear motion using a rotating screw drive. However, in FIG. 10B, translating nut 78 is disengaged from pressing screw 26. Alter the user is finished repairing powder 14, he or she can slide or press release switch 80 as shown in FIG. 10A. Although it is referred to as "press release switch," press release switch 80 can be a switch, slider, or another similar device. In a preferred embodiment, press release switch 80 is a spring loaded switch or button whereby a user can press switch 80 and hold switch 80 in order to disengage the threads of translating nut 78 as shown in FIG. 10B. In addition, press release switch can be a slider or switch attached to a linkage to translate each half of nut 78 outward (away from pressing screw 26 in FIG. 10B). The switch or slider is located on the outside of housing 22, as shown in FIG. 10A.

Preferably, translating nut 78 is contained within top portion 36 of housing 22. Once the user presses release switch 80, each half of translating nut disengages from pressing screw 26. Translating nut 78 translates linearly within top portion 36 until both halves of nut 78 are completely clear of opening 40. Thus, pressing screw 26 is tree to translate within opening 40 with the need to rotate pressing screw 26.

In some instances, simply pressing powder 14 with compressing plate 30 does not completely repair the powder cracks 16 and pieces 18. When pressing powder 14 is unsuccessful, the user preferably sprays powder pieces 18 with an alcohol and water solution, then represses powder 14. Typically, the dampness of the powder 14 allows the powder to more easily press together, thereby creating a uniform mold. In extreme cases, powder pieces 18 may need to be sprayed with an alcohol and water solution and mixed into a paste which then can be pressed in order to form a powder mold.

Figure 11:
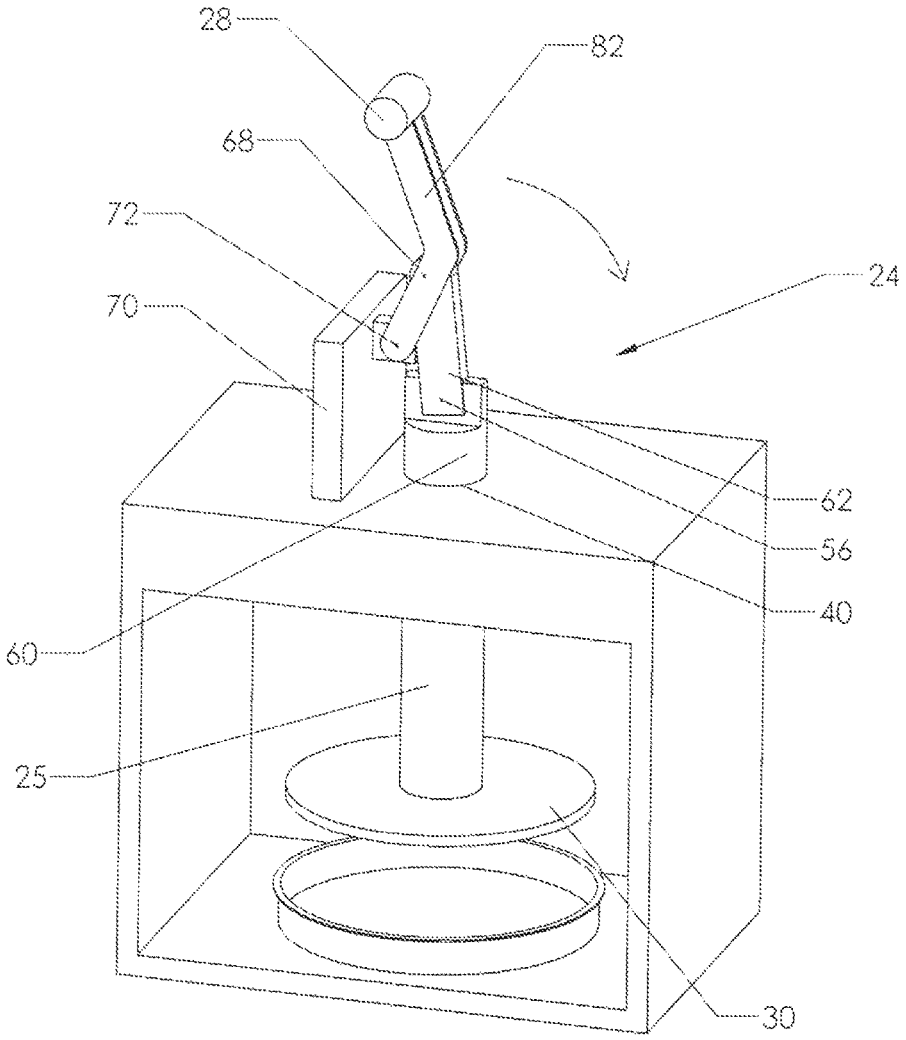
FIG. 11 is a perspective view, showing another embodiment of the present invention.

FIG. 11 shows an alternate embodiment of cosmetic repair device 20. In this embodiment, repair device 20 includes pressing handle 28, lever 82, shaft 25, opening 40, and piston linkage 62. In this embodiment, opening 40 and shaft 25 are not threaded. In this embodiment, shaft 25 acts as a piston 60. Preferably, the outer diameter of piston 60 is slightly smaller than the diameter of opening 40, thereby allowing piston 60 to translate smoothly within opening 40. The connection between piston 60 and piston linkage 62 is preferably a pin joint, thereby creating a pivot point 56. In addition, the connection between lever 82 and piston linkage 62 is also preferably a pin joint, which creates pivot point 68. In order for the pressing mechanism 24 of the present embodiment to operate correctly, pivot point 56 and pivot point 68 are preferred. In this embodiment of repair device 20, pressing mechanism 24 is supported using vertical mount 70. Lever 28 is attached to vertical mount 70 via a pin joint. As with the other pin joints, this connection between pressing handle 28 and vertical support creates a pivot point 72. These three pivot points are needed in order to allow piston 60 to translate axially (linearly) within opening 40.

Figure 12:
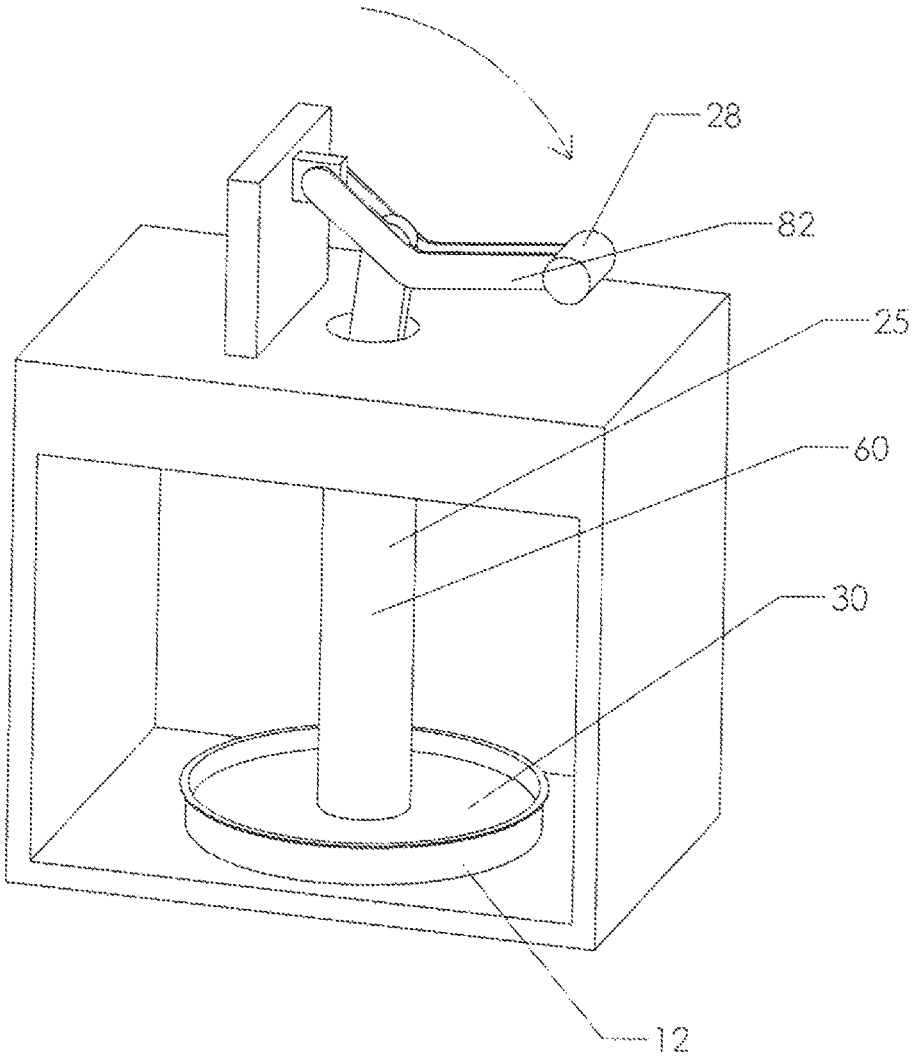
FIG. 12 is a perspective view, showing the embodiment of repair device shown in FIG. 11 in a closed state.

In order to lower compressing plate 30, the user pulls pressing handle 28 (attached to lever 82) downward and away from vertical mount 70 (to the right and downward in the view of FIG. 11). FIG. 12 shows the current embodiment in a closed configuration. As illustrated, lever 82 pivots on pivot point 72 when pulled as described. Pulling pressing handle 28 downward causes piston 60 to travel downward, thereby compressing the contents of container 12 (pressed powder 14—not visible) via compressing plate 30. The reader will note that because there is not rotation cause by a screwing pressing mechanism 24, thrust bearing 48 is unnecessary. Pure compression is achieved simply through pressing mechanism 24.

In some embodiments of the present invention a flexible, thin film may be inserted between the powder and compressing plate. This can be any useful thin sheet known in the art such as wax paper or the like.

While the preceding description and illustrations contain significant detail regarding the novel aspects of the present invention, it should not be construed as limiting the scope of the invention. Instead the specifics should be interpreted as providing examples of preferred embodiments of the invention. For example, pressing mechanism could also be in the form of a push rod assembly. Thus, the scope of the invention should be fixed by the following claims, rather than the specific examples given.

Having described our invention, we claim:

1. A cosmetic powder repairing device for use with a cosmetic case having a container containing cracked pieces of powder, comprising:

a. a housing including,
  i. a base,
  ii. a top portion,
  iii. at least one support connecting said base to said top portion,
  iv. a hole located on said top portion;
b. pressing mechanism including,
  i. a shaft having a first end and a second end,
  ii. a compressing plate attached to said first end of said shaft designed to fit within said container containing said powder;
c. wherein said shall is axially aligned with said hole on said top portion;
d. wherein said first end of said shaft and said compressing plate are contained within said housing between said base and said top portion;
e. a receiving plate;
f. a thrust bearing;
g. wherein said thrust bearing is attached to said base and said receiving plate is attached to said thrust bearing; and
h. said container rests on said receiving plate.

2. A cosmetic powder repairing device as recited in claim 1, wherein:

a. said second end of aid shaft includes a handle;
b. said hole located on said top surface is internally threaded;
c. said shaft is externally threaded;
d. said externally threaded shaft and said internally threaded hole correspond to each other; and
e. said handle is rotated in order to translate said compressing plate into said container in order to compress said pieces of powder.

3. A cosmetic powder repairing device as recited in claim 1, further comprising:

a. a mount extending from said top portion;
b. a lever having a first end, a second end, and midpoint;
c. wherein said first end of said lever is pivotally attached to said mount;
d. wherein said second end of said lever includes a handle;
e. a linkage having a first and a second end wherein said first end is pivotally attached to said lever at a position proximate said midpoint of said lever;
f. said second end of said linkage attached to said second end of said shaft; and
g. wherein said shaft is slidably engaged with said hole on said top portion.

4. A cosmetic powder repairing device as recited in claim 1, wherein said compressing plate is removably attached to said Shaft.

5. A cosmetic powder repairing device as recited in claim 2, wherein said compressing plate is removably attached to said shaft.

6. A cosmetic powder repairing device as recited in claim 2, wherein said hole on said top portion includes a one-way quick release mechanism which disengages said threads and allows said shaft to easily translate within said hole on said top surface.

7. A cosmetic powder repairing device as recited in claim 1, wherein:

a. said hole on said top portion is centrally located; and b. said receiving plate includes a centrally mounted magnet.

8. A cosmetic powder repairing device as recited in claim 1, wherein said thrust bearing is a ball bearing.

9. A cosmetic powder repairing device as recited in claim 4, wherein said compressing plate is attached to said shaft via a threaded boss.

10. A cosmetic powder repairing device for use with a cosmetic case having a container containing cracked pieces of powder, comprising:

a. a housing including, i. a base, ii. a top portion, iii. at least one support connecting said base to said top portion, iv. a hole located on said top portion;

b. a pressing mechanism including, i. a shaft having a first end and a second end, ii. a compressing plate removably attached to said first end of said shaft designed to lit within said container containing said powder;

c. wherein said shaft is axially aligned with said hole on said top portion;

d. wherein said first end of said shaft and said compressing plate are contained within said housing between said base and said top portion;

e. wherein said second end of said shaft includes a handle;

f. wherein said hole located on said top surface is internally threaded;

g. wherein said shaft is externally threaded;

h. wherein said externally threaded shaft and said internally threaded hole correspond to each other;

i. wherein said handle is rotated in order to translate said compressing plate into said container In order to compress said pieces of powder;

j. a receiving plate;

k. a thrust bearing;

l. wherein said thrust bearing is attached to said base and said receiving plate is attached to said thrust bearing; and m. said container rests on said receiving plate.

11. A cosmetic powder repairing device as recited in claim 3 wherein said compressing plate is removably attached to said shaft.

12. A cosmetic device as recited in claim 10, wherein said hole on said top portion includes a one-way quick release mechanism which disengages said threads and allows said shaft to easily translate within said hole on said top surface.

13. A cosmetic powder repairing device as recited in claim 10, wherein;

a. said hole on said top portion is centrally located; and b. said receiving plate includes a centrally mounted magnet.

14. A cosmetic powder repairing device as recited in claim 10, wherein said thrust bearing is a ball bearing.

15. A cosmetic powder repairing device for use with a cosmetic case having a container containing cracked pieces of powder, comprising:

a. a housing including, i. a base, ii. a top portion, iii. at least one support connecting said base to said top portion, iv. a hole located on said top portion;

b. a pressing mechanism including, i. a shaft having a first end and a second end, ii. a compressing plate removably attached to said first end of said shaft designed to fit within said container containing said powder;

c. wherein said shaft is axially aligned with said hole on said top portion;

d. wherein said first end of said shaft and said compressing plate are contained within said housing between said base and said top portion;

e. a mount extending from said top portion;

f. a lever having a first end, a second end, and a midpoint;

g. wherein said first end of said lever is pivotally attached to said mount;

h. wherein said second end of said lever includes a handle;

i. a linkage having a first and a second end wherein said first end is pivotally attached to said lever at a position proximate said midpoint of said lever;

j. said second end of said linkage attached to said second end of said shaft;

k. wherein said shaft is slidably engaged with said hole on said top portion;

l. a receiving plate;

m. a thrust bearing;

n. wherein said thrust bearing is attached to said base and said receiving plate is attached to said thrust bearing; and o. said container rests on said receiving plate.

16. A method of repairing cracked cosmetic powder that is contained in a container of a cosmetic case, comprising the steps of:

a. providing a cosmetic powder repair device having:

i. housing including, 1. a base, 2. a top portion, 3. at least one support connecting said base to said top portion, 4. a hole located on said top portion;

ii. a pressing mechanism including, 1. a shaft having a first end and a second end, 2. a compressing plate attached to said first end of said shaft designed to lit within said container containing said powder;

iii. wherein said shaft is axially aligned with said hole on said top portion;

iv. wherein said first end of said shaft and said compressing plate are contained within said housing between said base and said top portion;

v. a receiving plate;

vi. a thrust bearing;

vii. wherein said thrust bearing is attached to said base and said receiving plate is attached to said thrust bearing; and viii. said container rests on said receiving plate;

b. applying a solution comprising alcohol and water to the said cracked cosmetic powder;

c. pressing said pressing mechanism to bring said compressing plate into said container containing said powder and into direct contact with the said powder;

d. continuing pressing said pressing mechanism;
e. moving said pressing mechanism up to check if said powder has formed a continuous piece.

17. A method of repairing cracked cosmetic powder that is contained in a container of a cosmetic case, comprising the steps of:

a. providing a cosmetic powder repair device having:
  i. a housing including,
    1. a base,
    2. a top portion,
    3. at least one support connecting said base to said top portion,
    4. a hole located on said top portion;
  ii. a pressing mechanism including,
    1. a shaft having a first end and a second end,
    2. a compressing plate attached to said first end of said shaft designed to fit within said container containing said powder;
  iii. wherein said shaft is axially aligned with said hole on said top portion;
  iv. wherein said first end of said shaft and said compressing plate are contained within said housing between said base and said top portion;
  v. a receiving plate;
  vi. a thrust bearing;
  vii. wherein said thrust bearing is attached to said base and said receiving plate is attached to said thrust bearing; and
  viii. said container rests on said receiving plate;
b. placing a film on the top of said powder;
c. applying a solution comprising alcohol and water to the said cracked cosmetic powder;
d. pressing said pressing mechanism to bring said compressing plate into said container containing said powder and into contact with the said film;
e. continuing pressing said pressing mechanism;
f. moving said pressing mechanism up to check if said powder has formed a continuous piece.

18. A method of repairing cracked cosmetic powder that is contained m a container of a cosmetic case, comprising the steps of:

a. providing a cosmetic powder repair device having:
  i. a housing including,
    1. a base,
    2. a top portion,
    3. at least one support connecting said base to said top portion,
    4. a hole located on said top portion;
  ii. a pressing mechanism including,
    1. a shaft having a first end and a second end,
    2. a compressing plate attached to said first end of said shaft designed to fit within said container containing said powder;
  iii. wherein said shaft is axially aligned with said hole on said top portion;
  iv. wherein said first end of said shaft and said compressing plate are contained within said housing between said base and said top portion;
  v. a receiving plate;
  vi. a thrust bearing;
  vii. wherein said thrust bearing is attached to said base and said receiving plate is attached to said thrust bearing; and
  viii. said container rests on said receiving plate;
b. using a separation tool to break up said powder;
c. applying a solution comprising alcohol and water to the said cracked cosmetic powder;
d. pressing said pressing mechanism to bring said compressing plate into said container containing said powder and into direct contact with the said powder;
e. continuing pressing said pressing mechanism;
f. moving said pressing mechanism up to check if said powder has formed a continuous piece.

* * * * *